US005908111A

United States Patent [19]

Purdy

[11] Patent Number: 5,908,111

[45] Date of Patent: Jun. 1, 1999

[54] BLISTER PACK

[76] Inventor: Michael Purdy, 9 Caris Street, Deckham, Gateshead, Tyne & Wear, NE8 3XD, United Kingdom

[21] Appl. No.: 08/908,231

[22] Filed: Aug. 7, 1997

[51] Int. Cl.[6] ..... B65D 73/00

[52] U.S. Cl. ..... 206/461; 206/471; 229/87.03

[58] Field of Search ..... 206/461, 462, 206/463, 464, 465, 467, 468, 469, 470, 471, 815; 229/87.03

[56] References Cited

U.S. PATENT DOCUMENTS

| | | | |
|---|---|---|---|
| 3,154,827 | 11/1964 | Gentry | 206/815 |
| 3,392,823 | 7/1968 | Green et al. | 206/777 |
| 3,655,501 | 4/1972 | Tesch | 383/118 |
| 3,819,033 | 6/1974 | Hueber | 383/118 |
| 3,931,948 | 1/1976 | Mason, Jr. | 383/118 |
| 3,958,751 | 5/1976 | Bruno | 383/118 |
| 4,165,805 | 8/1979 | Fethke et al. . | |
| 5,269,430 | 12/1993 | Schlaupitz et al. | 206/815 |
| 5,492,675 | 2/1996 | Brizard | 206/461 |
| 5,653,345 | 8/1997 | Knoss et al. | 206/470 |
| 5,704,481 | 1/1998 | Lutz | 206/469 |

FOREIGN PATENT DOCUMENTS

| | | | |
|---|---|---|---|
| 682381 | 3/1964 | Canada | 229/87.03 |
| 4200353 | 7/1993 | Germany | 206/461 |
| 916940 | 1/1963 | United Kingdom | 206/462 |
| 1102918 | 2/1968 | United Kingdom . | |
| 2303617 | 2/1997 | United Kingdom . | |

*Primary Examiner*—Paul T. Sewell
*Assistant Examiner*—J. Mohandesi
*Attorney, Agent, or Firm*—Ratner & Prestia

[57] ABSTRACT

A blister pack comprises a cover member (12) and a support member (22). The cover member (12) includes a distortional region (14) formed from a plurality of slits (16) therein. A saleable item is located between the cover member (12) and the support member (22). The slits (16) allow the cover member to distort to the size of the saleable item.

18 Claims, 6 Drawing Sheets

BLISTER PACK

BACKGROUND OF THE INVENTION

The present invention relates to blister packaging for the display of saleable items and a method of manufacturing such blister packs.

Previously, blister packaging has been formed in one of two ways. In a first method, the blister package comprises a single moulded plastics sheet adapted to be folded along a central region. In one or each side of the folded region a blister (or recess or protrusion) is formed. Where such a blister is formed in each side, it is preferred that after folding of the plastics sheet the two blisters are aligned to form a single storage region. The plastics sheet is otherwise generally planar. The item or items to be sold are for convenience usually located within the blister prior to folding of the plastics sheet.

A second method, commonly known as captive blister packaging, comprises a planar sheet of plastics material into which a blister (or recess or protrusion) has been formed, held between a front and a back sheet of cardboard, the front sheet being provided with an opening through which the blister (but not the surrounding planar region of the plastics sheet) extends.

One shortcoming associated with these conventional blister packages is the fact that a moulding process is used to form the plastics sheet and the blister. As an alternative to moulding, it is possible to stamp the blister into the planar plastics sheet. However, even this method suffers the same problem, which is that it is an expensive process to form either the mould or the stamp. Furthermore expenses are increased when different sizes of articles are required to be packaged as this involves either remoulding or providing a new stamp.

A further problem with conventional blister packaging is that it offers a potential purchaser no chance to feel or touch the article prior to sale. Potential purchasers frequently desire to touch the article before purchase. There are several reasons to explain the popularity of this so-called "interactive" packaging. One such reason being that the potential purchaser has the ability to move the article around and see what it looks like from several different angles.

Whilst it is often possible for conventional packaging to be opened and resealed to achieve the above, it is the case that many customers will not purchase an item if its packaging has been tampered with.

SUMMARY OF THE INVENTION

According to a first aspect of the invention there is provided a blister pack comprising a support member and a cover member having a distortional region, the cover member being mounted upon or formed integrally with the support member, wherein an article to be held within the pack is retained between the support member and the cover member, the pack characterised in that the distortional region has a plurality of slits formed through the cover member, wherein the slits of the plurality extend (preferably radially and/or tangentially) towards an edge of the cover member. Hence the present invention retains the advantages of conventional blister packaging, i.e. allowing the packaged article to stand proud of its backing sheet, yet offers the ability for the package to be easily adaptable in order to accommodate different sized articles without the need to modify a moulding or a stamp.

Preferably, the slits extend from a centre region of the cover member.

Additionally, the slits of the plurality may be non-linear and are preferably arcs of constant radius.

In the distortional area each pair of adjacent slits defines a leg which connects the centre portion of the cover member to the edges thereof. The connection is resilient, in that the legs can deform and allow the centre portion to move relative to the edge of the cover member and the support member. Accordingly the invention also provides a blister pack comprising a distortional region having a plurality of legs extending from a centre portion of the distortional region towards its edge.

Advantageously the distortional region provided by the plurality of slits is formed as a circumscribed region within the cover member.

Optionally the support member and the cover member are formed integrally from a single substrate. Alternatively, the support member can be separately formed with an aperture through which the distortional area extends in use. Further, the aperture can be circular or otherwise and can have one or more shoulders extending inwardly from its periphery to abut the legs of the distortional area. This aspect can result in an increase in the tension on the legs, and can hold the article more securely in the distortional area.

According to a second aspect of the invention, a method of forming a blister package for a saleable item comprises the steps of a) providing a support member;

b) providing a cover member;

c) punching, cutting or otherwise forming a plurality of slits in the cover member, wherein the slits extend (preferably radially and/or tangentially) towards an edge of the cover member;

d) locating the saleable item between the support member and the cover member, and beneath the slit region of the cover member; and e) securing the support member and the cover member together.

BRIEF DESCRIPTION OF THE DRAWINGS

The present invention will now be described, by way of example only and with reference to the accompanying drawings, in which.

DETAILED DESCRIPTION OF THE INVENTION

Figure 1:
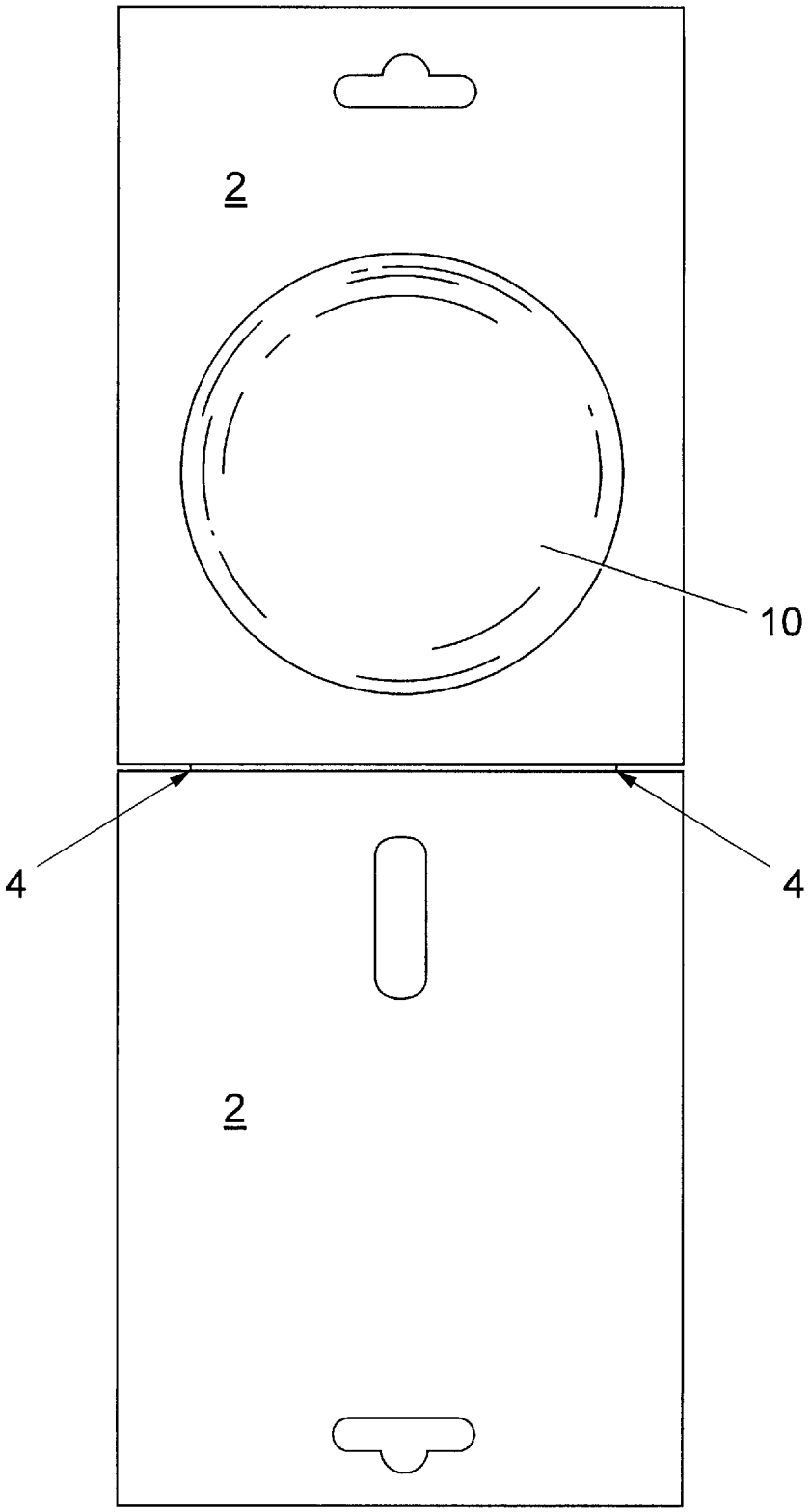
FIG. 1 illustrates schematically a conventional blister pack.

Referring firstly to FIG. 1, a conventional blister pack is illustrated which comprises a two-part planar plastics sheet 2. The parts are joined together by a plastics hinge 4. The two parts 2 are formed from one single sheet of plastics material, but with some of the material punched out in order to leave the hinges 4.

In use of the pack shown in FIG. 1, the two halves of plastics sheet 2 are folded one on the other about the hinges 4. When the two halves close, around the periphery of one half is formed a projection and around the periphery of the other half is formed a furrow (not shown for the sake of clarity). As the projection and the furrow come together, they form a snap-fit connection which effectively joins the two halves into a single unit. Prior to folding, a saleable article is placed within a blister 10 formed in one half of the plastics sheet. The folding of the sheet thus retains the saleable item within the blister 10 and between the blister 10 and an opposing half of the sheet 2.

Figure 2:
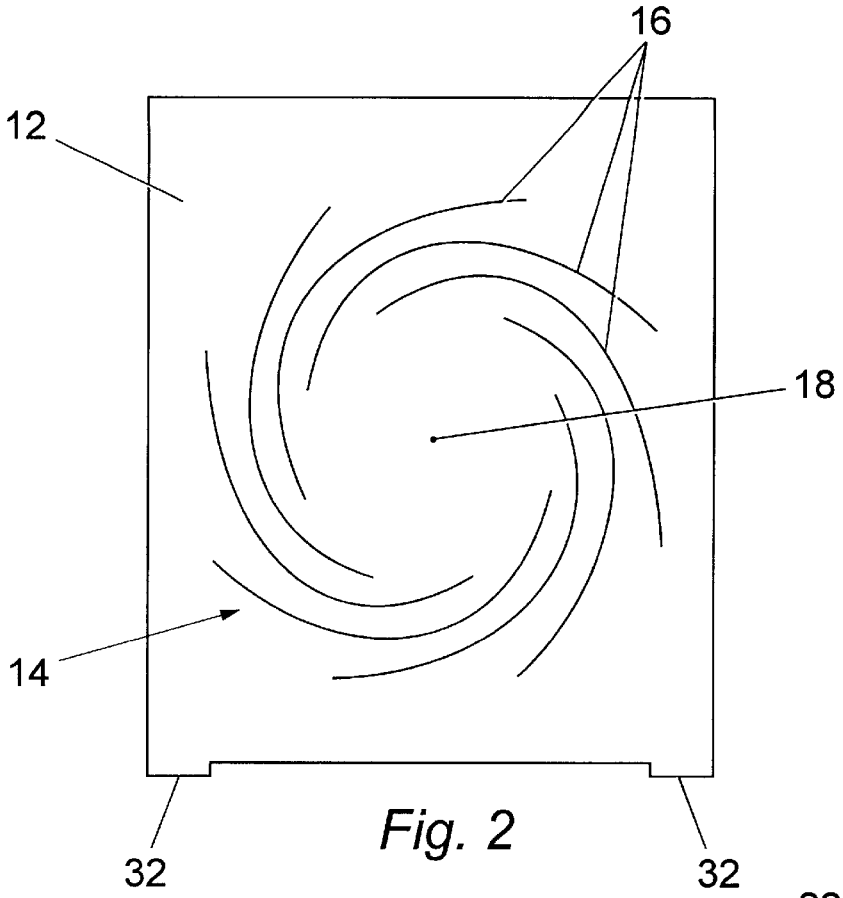
FIG. 2 shows a plan view of a cover member in accordance with the present invention.

Referring to FIG. 2, a cover member 12 forming part of the present invention is shown. The cover member 12 is conveniently formed as a planar sheet of plastics material, preferably a transparent PVC sheet. A distortional region 14 is shown comprising a plurality of slits 16, each slit 16 extending completely through the thickness of the cover member 12.

The slits extend both radially and tangentially away from a point 18, shown in the present embodiment as the central point of the cover member.

Figure 3:
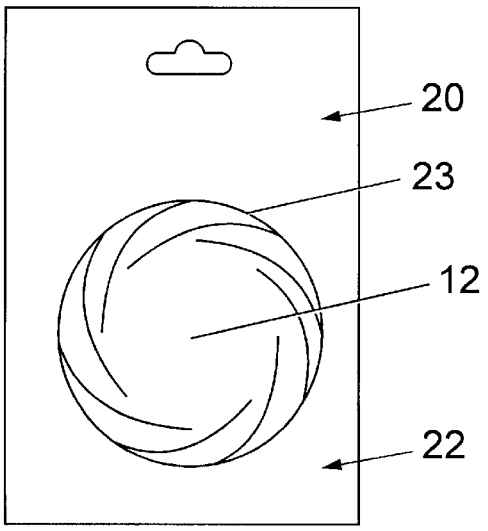
FIG. 3 shows a plan view of a first embodiment of a blister pack in accordance with the present invention.

Considering FIG. 3, there is shown a blister package 20 comprising a support member 22 overlying the cover member 12. The support member 22 is formed with an opening 23. The opening 23 is preferably circular. The support member may comprise a single sheet, adapted simply to overly the cover member 12. In such a case, the planar region of the cover member 12 will be secured to the rear of the support member 22 by any suitable means.

Alternatively, the support member may comprise a larger sheet folded into two and may secure the cover member by having it located therebetween. The planar region of the cover member may be secured directly to the cover member or may be merely held captive therebetween. It will be understood that the same effect may be obtained if the support member is formed of two parts, a front sheet and a rear sheet.

In a further alternative construction, the support member 22 and the cover member 12 may be formed from a single sheet of material, preferably of plastics material. In such a case the sheet would be folded over, such that the cover member overlies the support member.

Figure 5:
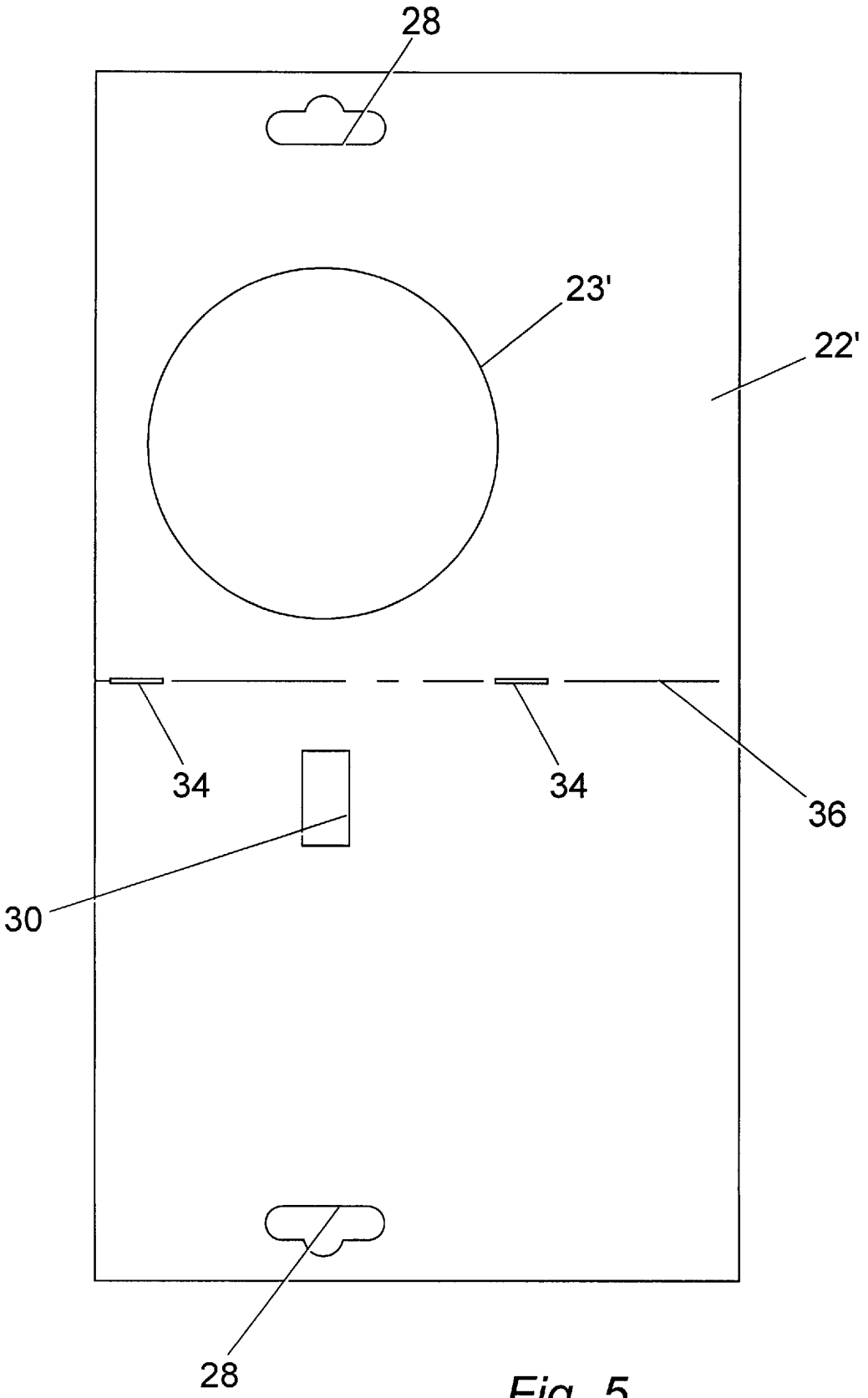
FIG. 5 shows a support member for a second embodiment of the present invention.

In FIG. 5, a further embodiment of a support member 22' is shown. The support member is divided into two equal parts. Each half is formed with a regularly shaped hole 28. On folding each half will lie on top of the other such that the two regularly shaped holes 28 register with one another to form a hanging slot for the packaging.

A circular hole 23' is provided in one half of the support member 22' to allow the distortional region 14 of the cover member 12 to extend therethrough as will be explained below.

The support member 22' is shown with two gaps 34 formed along a line 36 bisecting the support member. Referring back to FIG. 2, it can be seen that the cover member 12 may be formed with feet 32. These feet 32 may engage with the gaps 34 to locate the cover member 12 with respect to the support member, ensuring the distortional region 14 is within the opening 23'.

Figure 4:
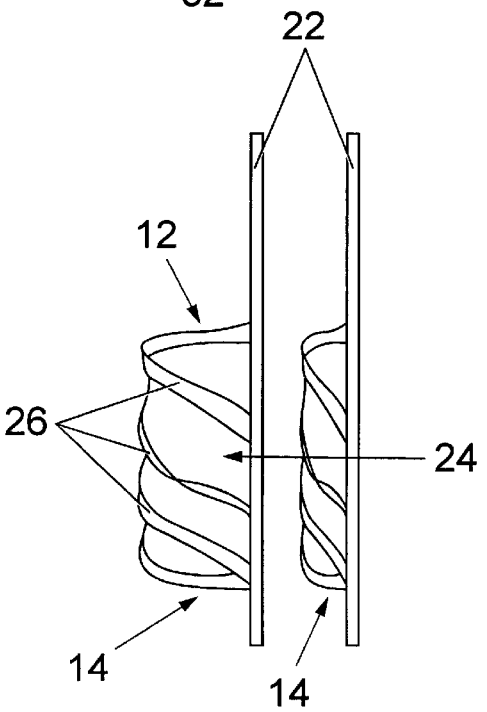
FIG. 4 shows side views of two blister packs with differing degrees of distortion.

As can be seen from FIG. 4, when a saleable item (not shown) is captured between the support member 22 and the cover member 12 in the distortional region 14, the distortional region distorts to provide an encapsulation region 24 for the article. It will be understood now why the slits 16 preferably extend both radially and tangentially as described above, since this facilitates the expansion of distortional region 14 (out of the plane of the paper as viewed in FIG. 3) thereby to create the encapsulation region 24.

It can be seen that the length of the slits 16 influences the degree to which the distortional region 14 can distort. Thus large saleable items for packaging would require longer slits than smaller saleable items for packaging. In any event, it would be apparent that the rest position for the distortional region 14 is to sit flush with the remainder of the cover member (ie. planar). Thus assuming that the distortional region can, when fully distorted, accommodate the item to be packaged, smaller items can alternatively be accommodated within the same distortional region. Thus the present invention provides for a versatile blister pack able to accommodate various sizes of item to be packaged. This offers significant advantages over conventional blister packaging by obviating the need for new moulds or stamps because a single member 12 is able to contain a range of different sized items.

Figure 6:
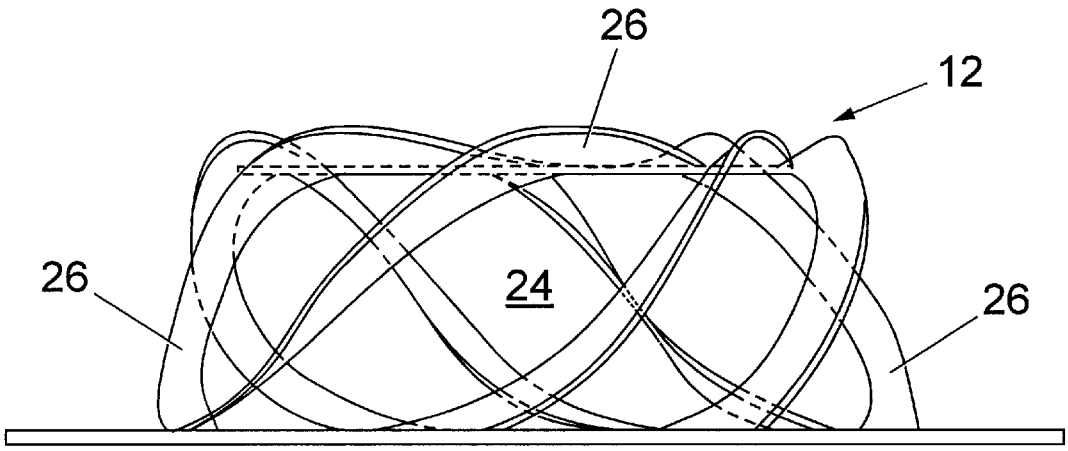
FIG. 6 shows a cover member according to the present invention in a distorted configuration.

Furthermore, when the distortional region 14 is distorted, gaps between the "legs" 26 are formed. The legs 26 are, as will most clearly be seen from FIGS. 4 and 6, simply those portions of the plastics sheet in between consecutive slits 16. Depending upon the number of slits 16 formed in the cover member 12, these gaps between the legs 26 could be quite large. This then allows a prospective consumer to be able to touch and move the item within the blister pack.

Figure 7:
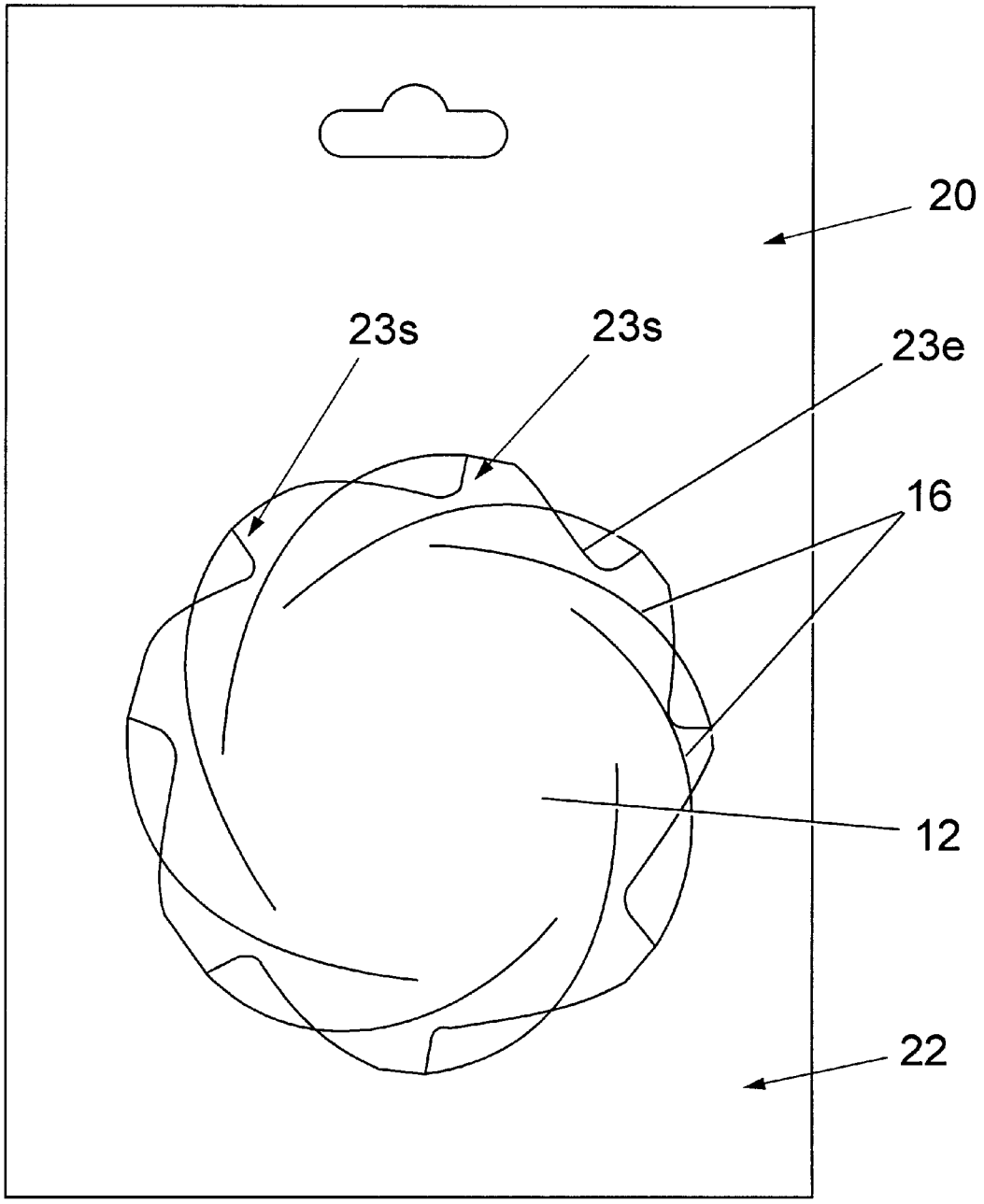
FIG. 7 shows a further embodiment of the invention.
Figure 8:
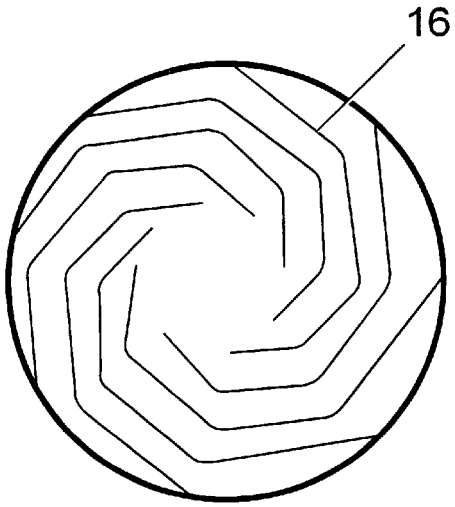
FIG. 8 shows a further embodiment of the invention.
Figure 9:
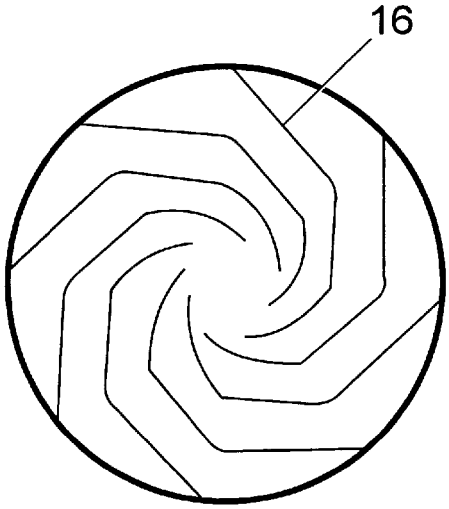
FIG. 9 shows a further embodiment of the invention.
Figure 10:
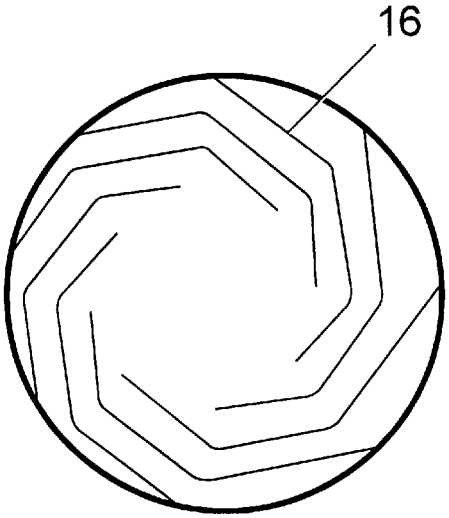
FIG. 10 shows a further embodiment of the invention.
Figure 11:
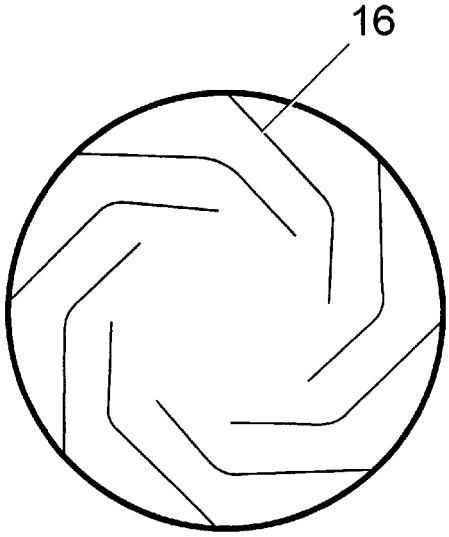
FIG. 11 shows a further embodiment of the invention.

A further embodiment of the invention is shown in FIG. 7. In this embodiment, the blister package is as described in FIG. 3, except that the opening is shaped at its edges **23*e* to include shoulders 23*s* which protrude inwardly towards the centre of the distortional region. The shoulders 26*s* each have an acutely angled side extending in a straight line from the edge 23*e* radially towards the centre of the opening; and a sloped side which extends on an arcuate path from the apex of the shoulder 23*s* to a point on the edge 23*e* where the acutely angled side of the adjacent shoulder 23*s* emerges. The slits 16 are aligned with the shoulders 23*s* such that each slit 16 meets the edge 23*e* of the aperture at one of said points on the edge 23*e* where the acutely angled side and the sloped side meet. The shoulders 23*s* exert additional tension on the legs 26**.

Whilst in the above examples, arcuate slits have been shown, it will be apparent that any shape will suffice, such as linear or non-linear shapes. The slits 16 can be linear or arcuate, or a combination of both as in further examples of the invention shown in FIGS. 8, 9, 10 and 11. Linear slits 16 preferably include one or more bends. Blister packages can incorporate two or more types of slits 16 which are respectively linear and arcuate and/or slits 16 which include both linear and arcuate portions.

Blister packs can incorporate two or more distortional regions. For example, the pack can comprise two distortional regions placed back to back.

The slits 16 may be formed in any suitable manner, such as cutting or slicing the cover member.

Those skilled in the art will appreciate that whilst in the above examples, the slits 16 are shown to totally surround or circumscribe the central region of the cover member, this is not essential. The slits 16 could equally only partially surround a region. In this case, the distortional region would appear angled with respect to the plane of the cover member.

Referring back to FIG. 5, it will be seen that a rectangular hole 30 has been provided in the other half to that containing the circular opening 23'. On folding the rectangular hole will be aligned with the circular opening. This provides further access to the saleable item for the potential purchaser.

It will be understood that if the saleable item is an item having a shaft, a further hold may be made in the support member to allow the shaft to pass therethrough. Alternatively, a hole may be formed in the cover member.

I claim:

1. A blister pack comprising a support member and a cover member, the cover member having a distortional region, the cover member being mounted upon or formed integrally with the support member, wherein an item to be held within the pack is retained in a blister between the support member and the cover member, wherein the distortional region has s plurality of slits formed through the cover member, wherein each of the slits of the plurality extend radially and tangentially in a direction from a central region of the cover member towards an edge thereof whereby the distortional region is adapted to distort relative to the support member to form the blister.

2. A blister pack according to claim 1, wherein the slits of the plurality are non-linear.

3. A blister pack according to claim 1 wherein the slits of the plurality are shaped as arcs of constant radius.

4. A blister pack according to claim 1, wherein the distortional region is formed as a circumscribed region within the cover member.

5. A blister pack according to claim 1, wherein the support member and the cover member are formed integrally from a single substrate.

6. A blister pack according to claim 1, wherein when an item to be held within the pack is retained between the support member and the cover member, the distortional region of the cover distorts so as to substantially encapsulate the item.

7. A blister pack according to claim 1, incorporating shoulders extending into the distortional region.

8. A blister pack according to claim 1, wherein the slits are at least partially linear and incorporate a bend.

9. A blister pack according to claim 1, wherein the slits include both linear and arcuate portions.

10. A method of forming a blister package for a saleable item, the method comprising the steps of a) providing a support member;

b) providing a cover member;

c) punching or cutting a plurality of slits into the cover member, wherein each of the slits extend both radially and tangentially in a direction from a central region of the cover member towards an edge of the cover member;

d) locating the saleable item between the support member and the cover member, and beneath the slit region of the cover member; and e) securing the support member and the cover member together.

11. A method according to claim 10 wherein the slits of the plurality are shaped as arcs of constant radius.

12. A method according to claim 10, wherein when an item to be held within the pack is retained between the support member and the cover member, the distortional region of the cover distorts so as to substantially encapsulate the item.

13. A method according to claim 10, the blister package incorporating shoulders extending into the distortional region.

14. A method according to claim 10, wherein the slits are at least partially linear and incorporate a bend.

15. A blister pack as claimed in claim 1, wherein the slits of the plurality are selected from the group consisting of spiral slits and helical slits.

16. A blister pack as claimed in claim 1, wherein adjacent slits of the plurality define between them legs which connect the central region of the cover member to the edge of the cover member.

17. A method of forming a blister pack as claimed in claim 10, wherein the slits of the plurality are formed in a shape selected from the group consisting of spiral slits and helical slits.

18. A method of forming a blister pack as claimed in claim 10, wherein adjacent slits of the plurality define between them legs which connect the central region of the cover member to the edge of the cover member.

* * * * *

UNITED STATES PATENT AND TRADEMARK OFFICE

CERTIFICATE OF CORRECTION

PATENT NO. : 5,908,111
DATED : June 1, 1999
INVENTOR(S) : Purdy

It is certified that error appears in the above-indentified patent and that said Letters Patent is hereby corrected as shown below:

Column 5, line 17, after "has", delete "s plurality" and insert --a plurality--.

Signed and Sealed this

Twenty-third Day of November, 1999

*Attest:*

Q. TODD DICKINSON

*Attesting Officer*

*Acting Commissioner of Patents and Trademarks*